US005386933A

United States Patent [19]

Greene et al.

[11] Patent Number: 5,386,933

[45] Date of Patent: Feb. 7, 1995

[54] MAP MOUNTING SYSTEM FOR STRAP APPLICATION

[76] Inventors: Alan D. Greene, 62 Willow Ridge Rd., N. Andover, Mass. 01845; Phillips T. Greene, 25 Canterbury Rd., Winchester, Mass. 01890; C. Richard Williams, 66 Captain Hills Rd., Duxbury, Mass. 02332

[21] Appl. No.: 148,577

[22] Filed: Nov. 8, 1993

[51] Int. Cl.[6] ..... A45F 3/14

[52] U.S. Cl. ..... 224/219; 224/227; 224/267

[58] Field of Search ..... 224/219, 222, 267, 236, 224/221; 206/37, 449

[56] References Cited

U.S. PATENT DOCUMENTS 2,599,311 6/1952 Anderson ..... 224/219
5,170,917 12/1992 Tourigny ..... 224/219

FOREIGN PATENT DOCUMENTS 2209928 1/1989 United Kingdom ..... 229/222

*Primary Examiner*—Henry J. Recla
*Assistant Examiner*—David J. Walczak

[57] ABSTRACT

An integral map holder and mounting system for attachment to an interchangeable strap. The strap allows the map or printed matter enclosed within the holder system to be worn on a limb or over a garment, typically at the wrist area, for easy and immediate referral during various activities such as skiing.

2 Claims, 3 Drawing Sheets

MAP MOUNTING SYSTEM FOR STRAP APPLICATION

References: U.S. Pat. No.

| | | |
|---|---|---|
| 5,183,193 | 2/1993 | Brandell |
| 5,178,311 | 1/1993 | McBride |
| 5,170,917 | 12/1992 | Tourigny |
| 4,415,106 | 11/1983 | Connell, et al. |
| 3,214,852 | 11/1965 | Ford |

FIELD OF THE INVENTION

The field of the invention disclosed by this application describes an integral map and holder to be mounted on an elastic strap worn about the wrist for the purpose of instant referral to printed matter in a convenient and fashionable manner. The intended use of the invention is that of a skier's trail guide to be worn while skiing. Several body-supported map holders and more specifically skier's map holders have been revealed by earlier U.S. Patents including U.S. Pat. Nos. 3,214,852; 4,415,106; 5,170,917; 5,178,311; 5,183,193. Our application presents several fundamental and unique features that are critical to the particular required function of our invention.

BACKGROUND OF THE INVENTION

A review of prior art relative to map holders generally and to ski map holders specifically depicted in existing patents exposes many advantages of a ski map that can be mounted on the wrist for use by a skier while skiing. Mention has been made of the convenience, increased safety factor, and potential cost savings in map production to be achieved by the various proposed devices.

U.S. Pat. No. 5,178,311 to McBride addresses these concerns and furthers the art through a device that can be concealed while skiing. The new features are described as ones to protect the map holder itself and to maintain the desired 'look' of the skiers outfit.

U.S. Pat. No. 5,170,917 to Tourigny addresses the issue of style in skiing by presenting a pocket-type of map or key and coin holder to be considered to be display apparel. U.S. Pat. No. 4,415,106 to Connell, et al. and U.S. Pat. No. 3,214,852 to Ford, et al. both address the issue of a map holder consisting of an integral strap and pocket for map storage.

U.S. Pat. No. 5,183,193 to Brandell is an elaborate holder apparatus encompassing both the pocket type of enclosure and a structure for supporting features to facilitate its use including reference to illumination and magnifying devices.

It is important also to consider the manner in which ski areas maps are presently dispensed. The ski area-provided maps are generally quite large. They are often visually attractive. Almost invariably they must be folded excessively and otherwise damaged during use. Although most areas provide the maps free to customers, the skier is obligated to purchase a map holder of the type described by the prior art in order to achieve the convenience of hands-free use and/or near instant referral. Because of the size of the maps that the ski areas provide, the map is damaged to conform to the confines of the map holders described by all patents uncovered and referenced as prior art. In addition, only a partial view of the map is available at any given time during use until the map is refolded and re-inserted into the map holders described by the prior art. One is less likely retain a damaged map as a souvenir guide despite its previous visual attraction. Thus waste is encouraged if one wishes to retain a pristine area map.

Although skiing is for many participants a highly fashion-conscious activity the nature of the prior art generally does not reflect that fact. The majority of the prior art must be adjusted and readjusted for each use in placing or removing the map holder and in every instance using straps or systems that are difficult or impossible to individualize or personalize.

Our map and holder system addresses shortcomings of the prior art through the development of an integral, protected map of all area trails and mounting method for attachment to a wide and adjustable or interchangeable elastic strap that encircles the wrist.

SUMMARY OF THE INVENTION

The invention claims several features that create a unique wrist-mounted laminated map system. The primary components consist of the integral map and mounting system, and an adjustable and/or interchangeable elastic wrist strap with a buckle.

The integral map and holder contains mounting tabs to be used for attachment to the strap. The map and holder is a rectangular element of essentially two dimensions with no effective dimension in thickness. The truly flat map and holder system may thus itself be inserted into the existing pocket type holders referenced as prior art or into a collector's album for example without damage or modification.

The interchangeable wrist strap allows an individual, a corporation, or an advertising group, etc., the opportunity to personalize the map system for fashion purposes, group identity programs such as hotel logos, etc., and/or promotional schemes. The adjustable elastic wrist strap allows the map system to remain on a garment that is not currently being worn, and/or to be easily removed without readjustment.

The map system is area specific in that an accurate, full area trail map itself is integral to the holder system. Strap options for colors, patterns, printed information, and such may also be specific for a particular area. However as the map system and wrist strap are fully interchangeable nearly unlimited combinations will available to the user and collector. As the map is protected within a durable, transparent, laminated plastic enclosure it may be suitable for purposes in addition to its intended purpose of providing direction to a skier, such as for keeping as a souvenir card.

DESCRIPTION OF THE PREFERRED EMBODIMENT

Figure 1:
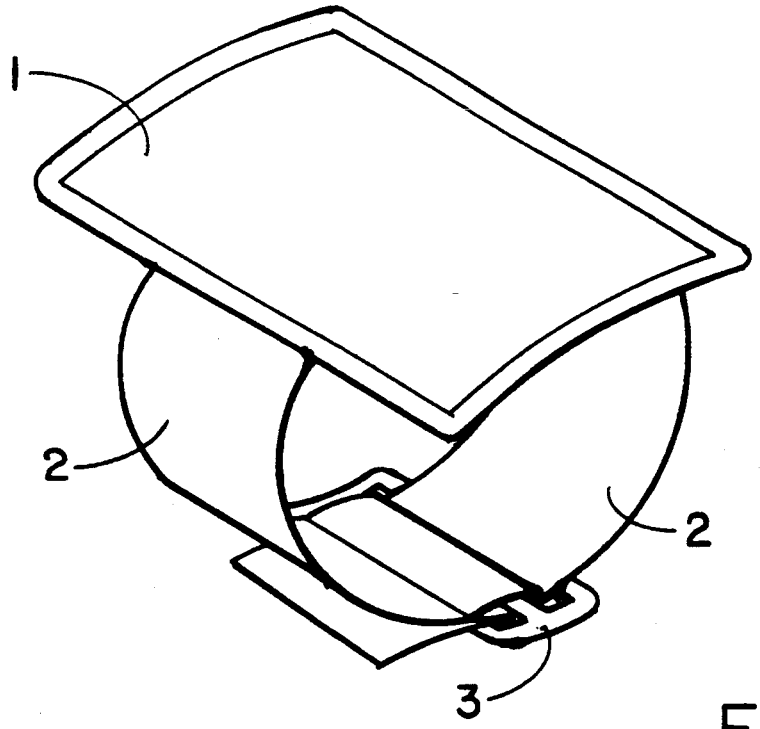
FIG. 1 Overall isometric view of the map/holder and strap system.
Figure 2:
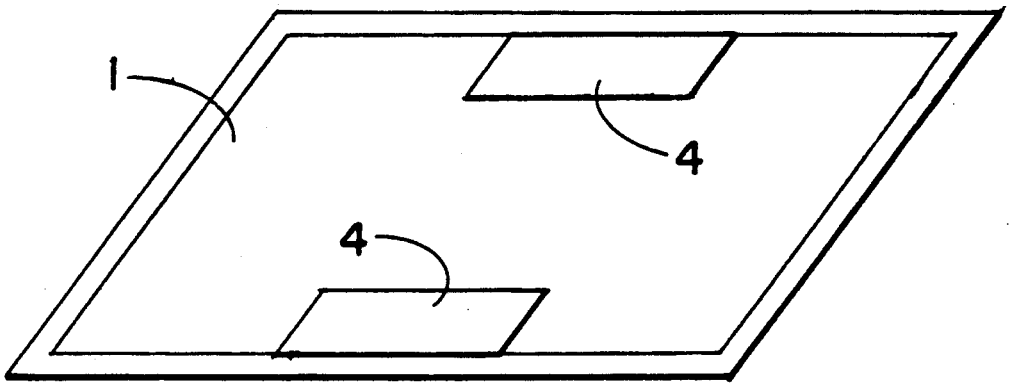
FIG. 2 Isometric view of the map/holder from the back showing strap mounting tab locations.

The primary components of the preferred embodiment consist of the map/holder laminate enclosure system 1 and an elastic wrist strap 2 with buckle 3 (FIG. 1 ). Mounting tabs 4 are located within the map/holder enclosure I on the opposite face of the preferred viewing surface (FIG. 2).

Figure 3:
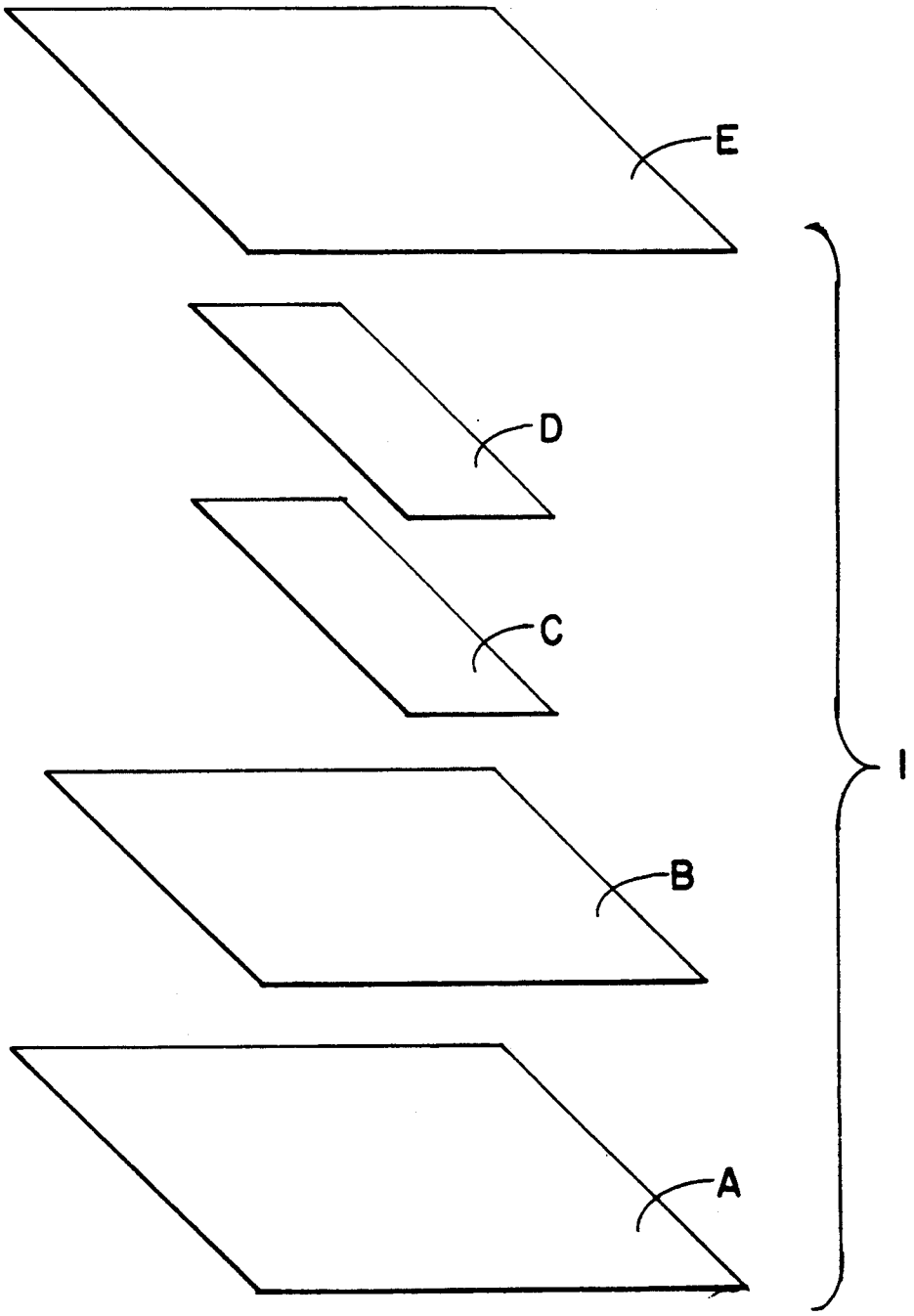
FIG. 3 Exploded view of the laminate sandwich.
Figure 4:
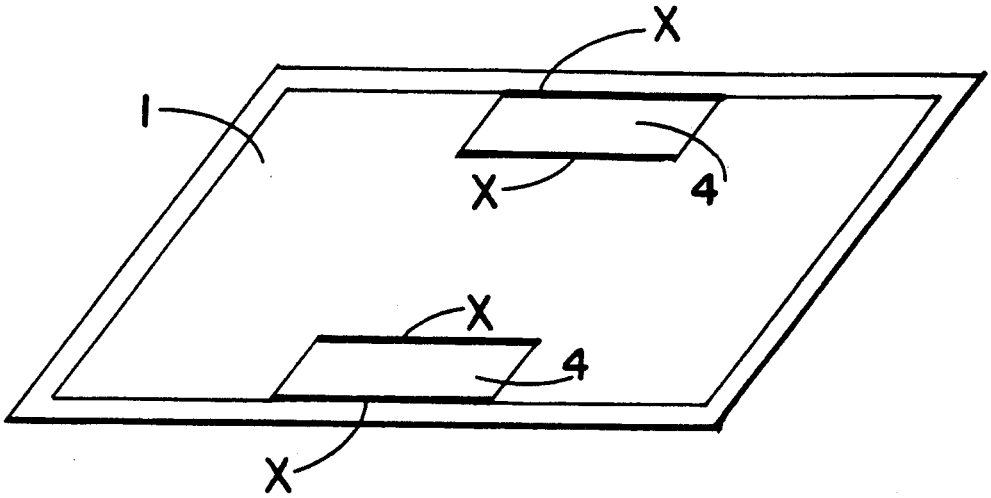
FIG. 4 View of the map/holder from the back showing where the slices are made to activate the mounting tabs.
Figure 5:
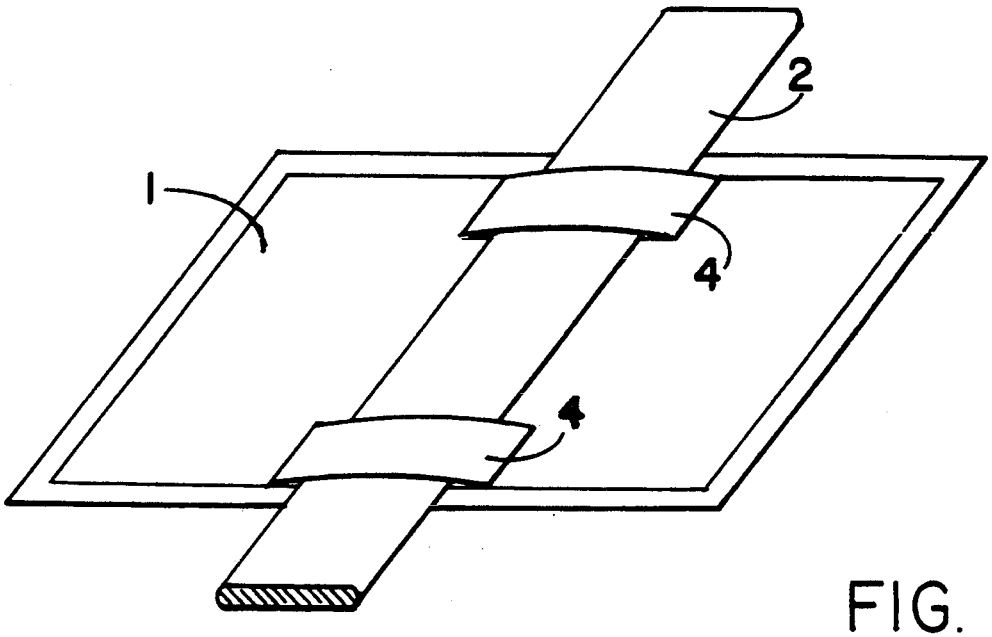
FIG. 5 View of strap inserted at mounting tab assembly.

The integral map/holder enclosure 1 is produced through construction of a plastic laminate sandwich of 3 and 5 layers, dependent upon where the section is taken. The sandwich 1 is configured as follows (FIG. 3 ): layer A—laminate rectangle slightly larger than printed matter area gloss or matte surface down and adhesive surface up; layer B—printed matter placed preferred side down; layer C—occurs at strap mounting tab area only—smaller rectangle approximately one-third to two-thirds the width of the printed matter and the same height as the printed matter of plastic laminate, with adhesive surface down and gloss or matte surface up; layer D—occurs at strap mounting tab area only—-plastic laminate of the same size as layer C with gloss or matte surface down and adhesive surface up; layer E—laminate rectangle of the same size as layer A with adhesive surface down and gloss or matte surface Up. The entire sandwich is bonded in a heat or cold, i.e. pressure type, laminating process using existing technology. All surfaces bond one to the other except where the gloss laminate surface meets another gloss laminate surface as between layers C and D. This is a preferred configuration that allows the strap 2 to move freely through the mounting tabs 4 created at this area in the step that follows. The areas at the strap mounting tabs are then sliced, cut, or die-stamped to open along the lines X (FIG. 4) as required to create two sleeves for the strap to pass through (FIG. 5). The proportion of each sleeve tab of the two tabs required is approximately one-fifth the height of the map/holder to a width slightly wider than the strap. The elastic strap 2 consists of a belt that encircles the wrist and is secured back upon itself with a buckle 3 (FIG. 1 ). The strap width is in a proportion of one-third to two-thirds the width of the overall integral map/holder. The strap and map/-holder system is held in place against the garment or limb through tension and friction.

We claim:

1. A mounting system for printed matter comprised of:

a transparent sheet;

a sheet having printed matter on a front surface thereof adhered to said transparent sheet such that the printed matter can be seen through said transparent sheet;

a first strip adhered to a surface of said sheet of printed matter opposite said front surface;

a second strip positioned over said first strip;

a backing sheet overlying said second strip and adhered to said transparent sheet to thereby form a laminate sandwich which encloses said printed matter; and slits cut in the backing sheet and the second strip to form sleeves which are adapted to receive a wrist strap.

2. The mounting system of claim 1 further including a wrist strap received in said sleeves.

* * * * *